United States Patent [19]

Kirkland et al.

[11] 4,285,810

[45] Aug. 25, 1981

[54] METHOD AND APPARATUS FOR FIELD FLOW FRACTIONATION

[75] Inventors: Joseph J. Kirkland, Wilmington; Wallace W. Yau, Newark, both of Del.

[73] Assignee: E. I. Du Pont de Nemours and Company, Wilmington, Del.

[21] Appl. No.: 134,288

[22] Filed: Mar. 26, 1980

Related U.S. Application Data

[63] Continuation-in-part of Ser. No. 125,851, Feb. 29, 1980, abandoned.

[51] Int. Cl.[3] ..... B03B 5/00

[52] U.S. Cl. ..... 209/155; 209/1; 73/432 PS; 233/27; 364/502

[58] Field of Search ..... 209/1, 155, 208, 444, 209/453, 11; 55/67, 81; 73/432 PS, 23.1; 210/198 C, 72; 233/1 R, 1 A, 1 D, 14 R, 23 R, 25, 26, 27

[56] References Cited

U.S. PATENT DOCUMENTS

| | | | |
|---|---|---|---|
| 3,449,938 | 6/1969 | Giddings | 73/23.1 |
| 3,523,610 | 8/1970 | Purcell et al. | 209/155 |

OTHER PUBLICATIONS

Giddings et al., "Programmed Thermal Field Flow Fractionation", Analytical Chemistry, vol. 48, No. 11, pp. 1587–1592, Sep. 1976.

Giddings et al., "Sedimentation Field-Flow Fractionation", Analytical Chemistry, vol. 46, No. 13, pp. 1917–1924, Nov. 1974.

Giddings et al., "Flow Programmed Field-Flow Fractionation", Analytical Chemistry, vol. 51, No. 1, pp. 30–33, Jan. 1979.

*Primary Examiner*—Ralph J. Hill

[57] ABSTRACT

The method described is useful in field flow fractionation techniques for reducing separation times and improving the convenience and accuracy of measuring sizes or molecular weights of particulates. In field flow fractionation, the particulates (particles or macromolecules) are subjected to a force field and a mobile phase while passing through a flow channel. This field strength is decreased exponentially as a function of time. Alternatively the flow velocity is increased exponentially as a function of time. The initiation of the change in field strength or flow velocity may be delayed a period of time. If this time delay is made equal to the time constant of the exponential decay, the range of particulate retention time that is linearly related to the logarithm of the particle size or molecular weight is increased.

An apparatus for implementing the method is also described and teaches the use of a function generator for providing the desired exponential decay and delay time. The apparatus is described in implementations involving a force field.

17 Claims, 4 Drawing Figures

METHOD AND APPARATUS FOR FIELD FLOW FRACTIONATION

This is a continuation-in-part of application Ser. No. 125,851, filed Feb. 29, 1980, entitled Method and Apparatus for Field Flow Fractionation, now abandoned.

CROSS-REFERENCE TO RELATED APPLICATIONS

This application is related to inventions described in copending applications Ser. No. 125,855, filed Feb. 29, 1980, entitled "Rotor for Sedimentation Field Flow Fractionation", by John Wallace Grant; Ser. No. 125,854, filed Feb. 29, 1980, entitled "Drive for Rotating Seal", by Charles Heritage Dilks, Jr.; Ser. No. 125,853, filed Feb. 29, 1980, entitled "Channel for Sedimentation Field Flow Fractionation", by Charles Heritage Dilks, Jr., Joseph Jack Kirkland and Wallace Wen-Chuan Yau; Ser. No. 125,852, filed Feb. 29, 1980, entitled "Apparatus for Field Flow Fractionation", by John Wallace Grant, Joseph Jack Kirkland and Wallace Wen-Chuan Yau; and Ser. No. 125,850, filed Feb. 29, 1980, entitled "Rotor for Sedimentation Field Flow Fractionation", by John Wallace Grant.

BACKGROUND OF THE INVENTION

Field flow fractionation is a versatile technique for the high resolution separation of a wide variety of particulates, including both particles and macromolecules, suspended in a fluid medium. The particulates include macromolecules in the $10^5$ to the $10^{13}$ molecular weight (0.001 to 1 $\mu$m) range, colloids, particles, unicelles, organelles and the like. The technique is more explicitly described in U.S. Pat. No. 3,449,938, issued June 17, 1969 to John C. Giddings and U.S. Pat. No. 3,523,610, issued Aug. 11, 1970 to Edward M. Purcell and Howard C. Berg.

Field flow fractionation is the result of the differential migration rate of components in a carrier or mobile phase in a manner similar to that experienced in chromatography. However, in field flow fractionation there is no separate stationary phase as is in the case of chromatography. Sample retention is caused by the redistribution of sample components between the fast to the slow moving strata within the mobile phase. Thus, particulates elute more slowly than the solvent front. Typically, a field flow fractionation channel consisting of two closely spaced parallel surfaces is used. A mobile phase is caused to flow continuously through the gap between the surfaces. Because of the narrowness of this gap or channel (typically 0.025 centimeters (cm)) the mobile phase flow is laminar with a characteristic parabolic velocity profile. The flow velocity is the highest at the middle of the channel and the lowest near the two channel surfaces.

An external influencing or force field of some type (the force fields include gravitational, thermal, electrical, fluid cross-flow and others as described variously by Giddings and Berg and Purcell), is applied transversely (perpendicular) to the channel surfaces or walls. This force field pushes the sample components in the direction of the slower moving strata near the outer wall. The buildup of sample concentration near the wall, however, is resisted by the normal diffusion of the particulates in a direction opposite to the force field. This results in a dynamic layer of component particles, each component with an exponential-concentration profile. The extent of retention is determined by the time-average position of the particulates within the concentration profile which is a function of the balance between the applied field strength and the opposing tendency of particles to diffuse.

In sedimentation field flow fractionation (SFFF), use is made of a centrifuge to establish the force field required for the separation. For this purpose a long, thin, annular belt-like channel is made to rotate within a centrifuge. The resultant centrifugal force causes components of higher density than the mobile phase to settle toward the outer wall of the channel. For equal particle density, because of their higher diffusion rate, smaller particulates will accumulate into a thicker layer against the outer wall than will larger particles. On the average, therefore, larger particulates are forced closer to the outer wall.

If now the fluid medium, which may be termed a mobile phase or solvent, is fed continuously in one end of the channel, it carries the sample components through the channel for later detection at the outlet of the channel. Because of the shape of the laminar velocity profile within the channel and the placement of particulates in that profile, solvent flow causes small particulates to elute first, followed by a continuous elution of sample components in the order of ascending particulate mass.

In a sedimentation field flow fractionation apparatus, with constant force field strength, particle retention is directly proportional to particulate mass and to the third power of particulate size. This fundamental relationship is described by Giddings et al. in a paper F. J. F. Yang, M. N. Myers, and J. C. Giddings, Analytical Chemistry, 46, 1924 (1974). Most SFFF separations have been carried out with a constant force field. Unfortunately, however, since SFFF retention in a constant field is linearly related to particulate mass, the dependence of retention time on particulate size is highly nonlinear. Hence, the conversion of a constant field SFFF fractogram to a sample particulate size distribution curve is inconvenient to say the least.

Further problems with constant field SFFF analysis or separations are the long times required to effect separation and the poor detection of late eluting species because of broad peaks. These problems are related to the fact that a constant field SFFF analysis does not exhibit constant resolution (separating power) across the desired wide particulate mass separation range. In constant field separations, the high field strength required to resolve small particulates invariably causes excessive retention of large particulates. In addition, late eluting large particulates are also badly dispersed (diluted) as they elute from the SFFF channel, causing detection problems.

Giddings et al. sought to reduce the long analysis time required and to alleviate the poor detectability resulting from constant field SFFF separations. They sought to do this by using step and linear field decay programs. Parabolic field programming of thermal gradients have also been used in thermal FFF. This is described in an article by J. C. Giddings et al., Analytical Chemistry, 48, 1587 (1976) entitled "Programmed Thermal Field-Flow Fractionation." Although these programming schemes improve the analysis time and sample detectability, they inadvertently create uncertainties in the quantitative relationship between retention and particle mass or particulate size. These programming schemes sacrifice the simple retention-mass relationship of constant field SFFF. It would also be highly desirable to provide SFFF separation techniques in which separation range and resolution could be varied, and at the same time a convenient retention-mass relationship could be maintained for easy and accurate determination of particulate size or molecular weights.

Giddings et al., in Analytical Chemistry, 46, 1917 (1974) noted that with increased flow rates, rapidly eluted components in field flow fractionation tend to merge into the void or solvent peak if high flow rates are used. Conversely if low flow rates are used, the more highly retained components are greatly delayed in their elution. Giddings et al. in Anal. Chem. 51, 30 (1979) suggest that the flow rate of the mobile phase may be increased in steps or by a simple proportional function to time raised to a power to alleviate some of these problems. Unfortunately, this method does not provide a convenient retention-mass (or field-affected particulate characteristic) relationship that is useful in analytical determinations.

SUMMARY OF THE INVENTION

The method and apparatus described herein utilize a simple exponential-decay field programming or exponential-increase flow velocity programming techniques to reduce the separating times required in FFF separations and improve detectability of eluting components. Further, exponential-decay and exponential-increase programming is used to provide linear logarithmic particulate size or molecular weight versus particle retention time calibration plots for quantitative particulate size or molecular weight analyses. A preferred alternative method uses a time-delayed exponential programming for logarithmic FFF separations over extended particulate size ranges.

A method is described for introducing a sample of particulates, including macromolecules and particles, into a fluid medium, passing the fluid medium, with the sample suspended therein, through a narrow flow channel, establishing a field, that influences a characteristic of particulates, across said flow channel to partition the particulates within the flow channel by selectively retarding different particulates according to their interaction with the influencing field and said fluid medium comprising the step of: decreasing the field strength exponentially as a function of time, whereby the separating time for said particulates is substantially reduced. According to a method of the invention, the field strength G is decreased according to the relationship $G(t)=G_o e^{-t/\tau}$ where G(t) is the influencing field strength at time $\tau$ following the start of field decrease, $G_o$ is the strength of the influencing field at the start of field decrease, and $\tau$ is the time constant of the exponential decrease in field strength, whereby the retention time of said particulates eluting from said flow channel is generally linearly related to the logarithm of the particulate characteristics.

In an alternative but preferred method of this invention, the influencing field strength G is initially maintained constant at an initial strength $G_o$ for a time equal to $\tau$, and then is varied according to the relationship $G(t)=G_o e^{-t/\tau}$. Using this alternative method, the range of retention times that are linearly related to the logarithm of said particulate characteristic is substantially increased.

In still another alternative method of the invention, the flow velocity $\langle v \rangle$ of said fluid medium through said flow channel is increased according to the relationship $\langle v \rangle_t = \langle v \rangle_o e^{t/\tau}$ where $\langle v \rangle_t$ is the average linear velocity of said fluid medium at time t following the start of flow, $\langle v \rangle_o$ is the initial average linear velocity of carrier mobile phase, and $\tau$ is the time constant of the exponential increase in flow velocity, whereby the retention time of said particulates in said flow channel is generally linearly related to the logarithm of said particulate characteristics.

In a preferred method of flow programming, the time of beginning the increase in flow velocity is delayed by the time $\tau$, the time constant of the exponential increase.

An apparatus is constructed according to this invention for separating particulates suspended in a fluid medium, said apparatus having a narrow flow channel, means for establishing a field across the channel that influences a characteristic of the particulates, means for passing the fluid medium through the flow channel, means for introducing a sample of said particulates into said fluid medium for passage through said flow channel, the improvement wherein the field establishing means includes programming means for decreasing the field strength exponentially as a function of time, whereby the separating time of said particulates is decreased relative to constant field operation.

In the case where the influencing field is a centrifugal force field, the means for establishing a field includes prime mover means for subjecting the flow channel to an angular momentum to establish a centrifugal force across said flow channel, and the programming means for decreasing the angular speed of said flow channel.

Similar appropriate apparatus is constructed for providing the exponential and exponential-delay flow velocity programming.

BRIEF DESCRIPTION OF THE DRAWINGS

Further advantages and features of this invention will become apparent upon the following description wherein.

DETAILED DESCRIPTION OF THE PREFERRED EMBODIMENT

The method and apparatus of this invention may be perhaps more easily understood if the operation of a typical SFFF apparatus is first described. Although an SFFF apparatus is described, it is to be understood that other influencing force fields may be used as well. These other force fields, as described by Giddings et al., include electrical, thermal, hydraulic or cross-flow, magnetic, and ultrasonic force fields. The principle of operation may be best understood with reference to FIGS. 1 and 2.

Figures 1, 2:
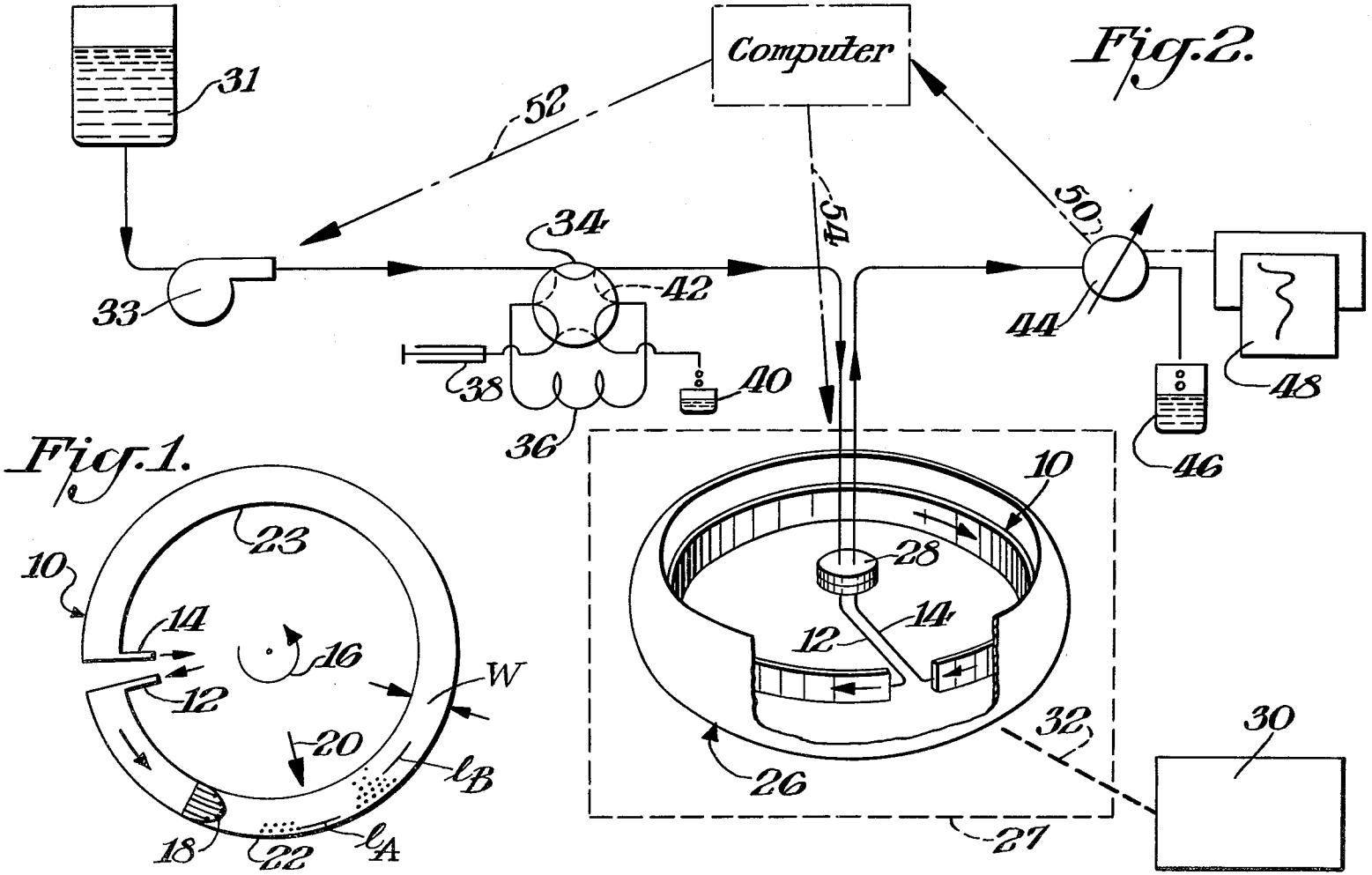
FIG. 1 is a simplified schematic representation of the sedimentation field flow fractionation technique.
FIG. 2 is a partial schematic, partially pictorial representation of a particle separation apparatus constructed in accordance with this invention.
Figure 3:
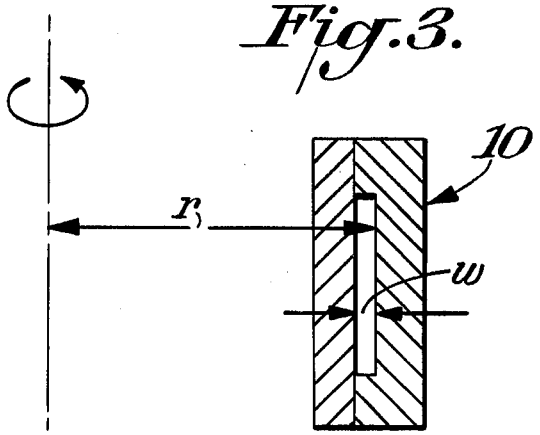
FIG. 3 is partial diagrammatic, partial cross-sectional illustration of a flow channel that may be used with this invention.

In FIG. 1 there may be seen an annular belt-like (or ribbonlike) channel 10 having a relatively small thickness (in the radial dimension) designated W. The channel has an inlet 12 in which the fluid medium (hereinafter referred to as the mobile phase, liquid or simply fluid) is introduced together with, at some point in time, a small sample of a particulate to be fractionated, and an outlet 14. The annular channel is spun in either direction. For purposes of illustration the channel is illustrated as being rotated in a counterclockwise direction denoted by the arrow 16. Typically the thickness of these channels may be in the order of 0.025 cm; actually, the smaller the channel thickness, the greater rate at which separations can be achieved.

In any event, because of the thin channel, fluid flow is laminar and assumes a parabolic flow velocity profile across the channel thickness, as denoted by the reference numeral 18. The channel 10 is defined by an outer surface or wall 22 and an inner surface or wall 23. If now a radial centrifugal force field, denoted by the arrow 20, is impressed transversely, that is at right angles to the channel, particulates are compressed into a dynamic cloud with an exponential concentration profile, whose average height or distance from the outer wall 22 is determined by the equilibrium between the average force exerted on each particulate by the field and by normal diffusion forces due to Brownian motion. Because the particulates are in constant motion at any given moment, any given particulate can be found at any distance from the wall. Over a long period of time compared to the diffusion time, every particulate in the cloud will have been at every different height from the wall many times. However, the average height from the wall of all of the individual particulates of a given mass over that time period will be the same. Thus, the average height of the particulates from the wall will depend on the mass of the particulates, larger particulates having an average height $\mathbf{1}_A$ (FIG. 1) and that is less than that of smaller particulates $\mathbf{1}_B$ (FIG. 1).

The fluid in the channel is now caused to flow at a uniform speed, so as to establish the parabolic profile of flow 18. In this laminar flow situation, the closer a liquid layer is to the wall, the slower it flows. During the interaction of the compressed cloud of particulates with the flowing fluid, sufficiently large particulates will interact with layers of fluid whose average speed will be less than the maximum for the entire liquid flow in the channel. These particulates then can be said to be retained or retarded by the field or to show a delayed elution in the field. This mechanism is described by Berg and Purcell in their article entitled "A Method For Separating According to Mass a Mixture of Macromolecules or Small Particles Suspended in a Fluid", I-Theory, by Howard C. Berg and Edward M. Purcell, Proceedings of the National Academy of Sciences, Vol. 58, No. 3, pages 862–869, September 1967.

According to Berg and Purcell, a mixture of macromolecules or small particulates suspended in a fluid may be separated according to mass, or more precisely what may be termed effective mass, that is, the mass of a particulate minus the mass of the fluid it displaces. If the particulates are suspended in the flowing fluid, they distribute themselves in equilibrium "atmospheres" whose scale heights, 1, depend on the effective masses, me, through the familiar relation $M_e a = kT$. In this relationship k is Boltzmann's constant, T is the absolute temperature, and a is the centrifugal acceleration. In view of this differential transit time of the particulates through a relatively long column or channel, the particulates become separated in time and elute at different times. Thus, as may be seen in FIG. 1, a cluster of relatively small particles $\mathbf{1}_B$ is ahead of and elutes first from the channel, whereas a cluster of larger, heavier particulates $\mathbf{1}_A$ is noticed to be distributed more closely to the outer wall 22 and obviously being subjected to the slower moving components of the fluid flow will elute at a later point in time.

In accordance with one embodiment the present invention, the time required to separate particulates, relative to that required in constant force field operation, is reduced by decreasing the field strength exponentially as a function of time. Although as noted above, the influencing field may be any of those noted. For the sake of simplicity of discussion, this decrease of field strength will be discussed, described and supported by a mathematical explanation in the case with particular reference to the case of SFFF.

Thus as described by Giddings et al., in SFFF the migration rate of retained sample components is slower than the linear velocity of the liquid carrier mobile phase by a factor R, the retention ratio:

$$R = 6\lambda\left[\coth\left(\frac{1}{2\lambda}\right) - 2\lambda\right] \quad (1)$$

where, $$\lambda = \frac{R_o T}{MGW \text{ in Formula No. 2. } (\Delta\rho/\rho_s)} \quad (2)$$

or, $$\lambda = \frac{6kT}{\pi d_p^3 GW\Delta\rho} \text{ (for spherical particles)} \quad (3)$$

with $G=\omega^2 r$. These and other symbols used in the above formulas and in the following development are listed in the following Table 1.

TABLE 1

| List of Symbols | |
|---|---|
| W | width of thickness of SFFF channel, (cm) |
| $\coth(\frac{1}{2}\lambda)$ | hyperbolic cotangent of $\frac{1}{2}\lambda$ |
| F | volume flowrate of carrier mobile phase (ml/min) |
| G | centrifuge sedimentation gravity field (cm/sec$^2$) |
| $G_o$ | initial sedimentation field (cm/sec$^2$) |
| k | Boltzman constant, $1.38 \times 10^{-16}$g . cm$^2$/sec$^2$ . degree C. |
| L | length of SFFF channel (cm) |
| l or l | characteristic particle layer thickness (cm) |
| M | particle mass (molecular weight of solvated macromolecules, or particle mass of colloidal dispensions, g/mole) |
| R | retention ratio |
| $R_o$ | gas constant, $8.31 \times 10^7$g . cm$^2$/sec. degree (°C.) . mole |
| r | centrifuge rotor radius (cm) |
| T | absolute temperature |
| $t_o$ | retention time of a solvent peak or any unretained sample component (min) |
| $t_R$ | retention time of sample components (min) |
| $<v>$ | average linear velocity of carrier mobile phase (cm/sec) |
| $<v>_t$ | average linear velocity of carrier mobile phase (cm/sec) at time t following the start of flow |
| $<v>_o$ | initial average linear velocity of carrier mobile phase (cm/sec) |
| $\rho_s$ | density of sample component (particle density or density of solvated macromolecules, g/cm$^3$) |
| $\Delta\rho$ | density difference between sample component and carrier mobile phase (g/cm$^3$) |
| $\tau$ | time constant of an exponential decay field |
| $\omega$ | programming (min) |
| dp | centrifudge speed(radians/seconds) particle diameter(cm) |

For highly retained sample components, simplifying approximations to Equation 1 are possible:

$$R \cong 6\lambda - 12\lambda^2 (\text{for } R < 0.7) \quad (4)$$

or, $$R \cong 6\lambda (\text{for } R < 0.3) \quad (5)$$

In simple exponential-decay field programmed SFFF, the retention ratio R becomes a function of time, depending on the particular field strength at the time, that is:

$$L = \int_o^{t_R} R(t) < v > dt \quad (6)$$

in this case time-dependent R(t) is still expressed by Equations 1–3, except that force field G is now a time-dependent exponential-decay function:

$$G(t) = G_o e^{-t/\tau} \quad (7)$$

where, $G_o$=initial sedimentation force field (cm/sec$^2$) and $\tau$=the exponential-decay time constant (min). Equations 2, 5, 6 and 7 lead to the following calibration relationship for exponential-field programmed SFFF:

$$\ln M = \ln[A(1 - e^{-t_R/\tau})] + t_R/\tau \quad (8)$$

where, $$A = \frac{6\tau R_o T}{t_o G_o W(\Delta\rho/\rho_s)} \quad (9)$$

For SFFF peaks resulting from relatively large $t_R$ to $\tau$ ratios, Equation 10 closely approaches the log-linear approximation:

$$\ln M = \ln A + t_R/t \quad (10)$$

From this it is apparent that there is a linear relationship between the logarithm of particulate mass with the retention time $t_R$. In the case of spherical particles, ln $d_p$ is proportional to ln M and hence is proportional to $t_R$.

The log linear relationship described above can be modified in accordance with a preferred embodiment of the field force programming method of this invention to increase the range of retention times that are linearly related to the logarithm of the particulate characteristic, in this case mass. This is accomplished by delaying the time of beginning the decrease in field strength by making the time of delay equal to the time constant of the exponential delay. This may be more clearly understood by the following mathematical development. A general form of the time delayed exponential decay filed strength relationship is $$G(t) = G_o e^{-(t-\chi)/\tau} (t > \chi) \quad (11)$$

where $\chi$=an arbitrary delay time (min). When $\chi=0$, Equation 11 reduces to Equation 7 for simple exponential-decay programming. In this case, SFFF retention characteristics under field-decay programming are as follows: for $t \leqq \chi$, $$L = 6\phi/M < v > \chi \quad (12)$$

$$L = \frac{6\phi}{M} < v > [\chi + \tau e^{(t_R-\chi)/\tau} - \tau] \quad (13)$$

-continued where, $$\phi = \frac{R_o T}{G_o W(\Delta\rho/\rho_s)} \quad (14)$$

Note that a true log-linear calibration is obtained for $t_R > \chi$ by allowing $\chi$ to equal $\tau$ in Equation 13. With this unique situation, logarithmic separations in SFFF can be optimized.

In a preferred SFFF operation, following sample injection the flow is started and the initial force field $G_o$ is maintained constant for a time equal to time $\tau$ which is also the exponential-decay time constant. After time $\tau$ the force field is allowed to exponentially decay with the time constant $\tau$.

for $t \leqq \tau$, $$G = G_o \quad (15)$$

$$M = 6\phi(t_R/t_o) \quad (16)$$

for $t > \tau$, $$G = G_o e^{-(t-\tau)/\tau} \quad (17)$$

$$M = 6\phi \left(\frac{\tau}{et_o}\right) e^{t_R/\tau} \quad (18)$$

For the desired logarithm function, Equation 18 becomes:

$$\ln M = \ln\alpha + t_R/\tau \quad (19)$$

$$\ln d_p = \ln\beta + t_R/3\tau \quad (20)$$

where, $$\alpha = \frac{6R_o T\tau}{et_o G_o W(\Delta\rho/\rho_s)} \quad (21)$$

and, $$\beta = \left(\frac{36kT\tau}{\pi e t_o G_o W\Delta\rho}\right)^{\frac{1}{3}} \quad (22)$$

Equations 16 and 18–22 were derived for highly retained components where $R \sim 6\lambda$. It may be shown (such showing is omitted here for the sake of brevity) that the effect of using the higher order approximation of R is only noticeable at peak retention values approaching $t_o$, which is of little practical consequence. This result indicates that the use of the rigorous but complex expression for R in Equation 1 is not expected to further influence the calibration curve characteristic significantly. On the contrary, equations 19 and 20 should be sufficiently accurate for most particle retention regions of practicl interest.

This time-delay exponential method results in a relatively wider linear range of logarithmic SFFF separations. It also should be noted that by using the method of this invention that the slope of the log linear relationship depicted by Equation 19 is controlled only by $\tau$ values. Flowrate, initial field strength, and other instrumental factors such as channel thickness affect only the intercept of the retention calibration plot. Thus, the retention time of sample components is only slightly effected by changing field strength and flowrate. Reference to Equation 19 shows that a halving of flow rate will not double sample component retention times. On the contrary, the peaks only elute slightly later without changing the relative peak separation spacings. These results are quite unexpected.

Among the advantages provided by the method of this invention are that large sample component particulates in a wide particulate size distribution are not forced as close to the wall of the flow channel as is the case is constant field SFFF separations. In effect, optimum exponential force-field programming in SFFF allows all sample components to be situated in a range of optimum particle layer thickness l away from the channel wall. This situation results in maximum resolution per unit time. Also, it can be expected that under these conditions fewer problems will occur as the result of surface roughness and adsorption effects of the channel wall. The effect of sample overloading should also be reduced. These advantages are due to the fact that in force field programming of this invention particulates are never allowed to approach the channel wall too closely. The separation range and resolution of that exponential decay SFFF of this invention can be conveniently controlled by varying $\tau$, $G_o$, or flow rate F.

It has also been found that SFFF, using the method of this invention, produces comparable band broadening for all peaks of similar polydispersity. This contributes significantly to improve analysis convenience and accuracy.

Apparatus for implementing the method of this invention may be that depicted in FIG. 2. In this figure, the channel 10 may be disposed in a bowl-like or ring-like rotor 26 for support. The rotor 26 may be part of a conventional centrifuge, denoted by the dashed block 27, which includes a suitable centrifuge drive 30 of a known type operating through a suitable linkage 32, also a known type, which may be direct belt or gear drive. Although a bowl-like rotor is illustrated, it is to be understood that the channel 10 may be supported by rotation about its own cylinder axis by any suitable means such as a spider (not shown) or simple ring. The channel has a liquid or fluid inlet 12 and an outlet 14 which is coupled through a rotating seal 28 of conventional design to the stationary apparatus which comprise the rest of the system. Thus the inlet fluid (or liquid) or mobile phase of the system is derived from suitable solvent reservoirs 30 which are coupled through a conventional pump 32 thence through a two-way, 6-port sampling valve 34 of conventional design through a rotating seal 28, also of conventional design, to the inlet 12.

Samples whose particulates are to be separated are introduced into the flowing fluid stream by this conventional sampling valve 34 in which a sample loop 36 has either end connected to opposite ports of the valve 34 with a syringe 38 being coupled to an adjoining port. A sample loop exhaust or waste receptacle 40 is coupled to the final port. When the sampling valve 34 is in the position illustrated by the solid lines, sample fluid may be introduced into the sample loop 36 with sample flowing through the sample loop to the exhaust receptacle 40. Fluid from the solvent reservoirs 31 in the meantime flows via the pump directly through the sample valve 34. When the sample valve 34 is changed to a second position, depicted by the dashed lines 42, the ports move one position such that the fluid stream from the reservoir 30 now flows through the sample loop 36 before flowing to the rotating seal 28. Conversely the syringe 38 is coupled directly to the exhaust reservoir 40. Thus the sample is carried by the fluid stream to the rotating seal 28.

The outlet line 14 from the channel 10 is coupled through the rotating seal 28 to a conventional detector 44 and thence to an exhaust or collection receptacle 46. The detector may be any of the conventional types, such as an ultraviolet absorption or a light scattering detector. In any event, the analog electrical output of this detector may be connected as desired to a suitable recorder 48 of known type and in addition may be connected as denoted by the dashed line 50 to a suitable computer for analyzing this data. At the same time this system may be automated if desired by allowing the computer to control the operation of the pump 33 and also the operation of the centrifuge 27. Such control is depicted by the dashed lines 52 and 54, respectively.

Suitable SFFF equipment that has been successfully used in the FIG. 2 embodiment is described below. Except for the centrifuge itself and related SFFF components, the remainder of the equipment was composed of high-performance liquid chromatographic modules.

The mobile phase or carrier reservoir was a narrow-mouth, one liter glass bottle. The end of the tube delivering the mobile phase to the pump is fitted with a 2 $\mu$m porous stainless steel filter to eliminate particles that might cause problems with the carrier metering system. All mobile phases used in this work were filtered through a 0.45 $\mu$m Millipore filter prior to use. Liquids were thoroughly degassed before loading into the mobile phase reservoir by applying a vacuum, to a vacuum flask while agitating in an ultrasonic bath for about 5 minutes. To maintain a low concentration of dissolved gases in the mobile phase reservoir during operation of the SFFF equipment, a slow stream of helium was delivered into the liquid through a coarse fritted glass gas dispersion tube. (Care was taken that resulting small helium bubbles did not enter into the inlet tube to the pump).

An Altex Model 100A solvent metering pump (Altex Scientific Inc., Berkeley, Calif.) was used to provide the precise mobile phase flowrates required. Since the backpressure of the SFFF system is relatively low, a short column of 40 $\mu$m glass beads (or a short length of crimped 0.025 cm i.d. capillary tubing) was placed after the pump to insure that it would operate against sufficient backpressure for proper check valve operation.

Sample injection was accomplished with a Model AHCV-6-UHPa-N60 air-actuated microsampling valve with a Valcon S rotor (Valco Instruments, Houston, Tex.). This valve with an external sample loop was mounted on the outside of the centrifuge and remotely actuated by a four-way air switching valve.

A Sorvall Model RC-5 centrifuge (Du Pont Instrument Products Division, Wilmington, Del.) was used to develop the centrifugal force fields required in SFFF. A Model TZ-28 titanium zonal rotor (Du Pont Instrument Products Division) was modified for use as the outer wall of the SFFF channel. The inside wall of this titanium rotor was carefully machined to a RMS 6–16 finish. The SFFF channel was formed by fitting to this polished surface a split-ring stainless steel insert by means of a 47½" long Teflon®-coated silicon rubber O-ring (Creavey Seal Company, Olyphant, Pa.) to form the seal between the polished titanium bowl wall and the stainless steel channel insert. A groove was carefully machined into this split-ring stainless steel insert to provide the spacing for the SFFF channel, so that when completely assembled would assume the dimensions of $58 \times 2.5 \times 0.025$ cm.

Mobile phase is pumped in and out of the rotating channel within the centrifuge by means of a rotating face seal. The lower half of this face seal is attached by connecting tubing to the channel inlet and outlet, and consists of a chrome-plated hardened steel button about 0.8 cm in diameter. This rotating seal face had been carefully machined to a high degree of flatness and a mirror finish. The stationary upper soft-seal is a button of the same diameter made of polyamide- and graphite-filled Teflon ® (Types 1834 and 5307 of a polymer from Valco Instruments Company, Houston, Tex.). This soft button also was machined to a high degree of flatness and a fine finish. Mobile phase was delivered through this rotating seal via 0.05 cm holes, one directly through the center and one offset by 0.23 cm. A small circular groove on the face of the soft button collected the fluid from the offset hole in the hard seal button, for delivery to the detector.

The rotating seal was assembled in a spring-loaded mount that was designed to maintain contact between the hard and soft faces during rotation of the seal at high speeds. This spring-loaded system was arranged to compensate for any off-axis movement of the rotor or unbalance during rotation.

The tubing connecting the sampling valve to the rotating seal, and the rotating seal to the detector were 0.05 cm i.d. stainless steel. Detection was accomplished with a Varian Variscan UV detector (Varian Associates, Walnut Creek, Calif.). Detector output was monitored with an Esterline Angus Speed Servo II recording potentiometer. A microprocessor computer may be programmed to vary the speed of the centrifuge motor or prime mover which drives the centrifuge rotor to decrease in speed according to the desired exponential function or, the exponential decay field can be achieved by a simple resistance-capacitor network that controls the voltage that drives the centrifuge motor.

Figure 4:
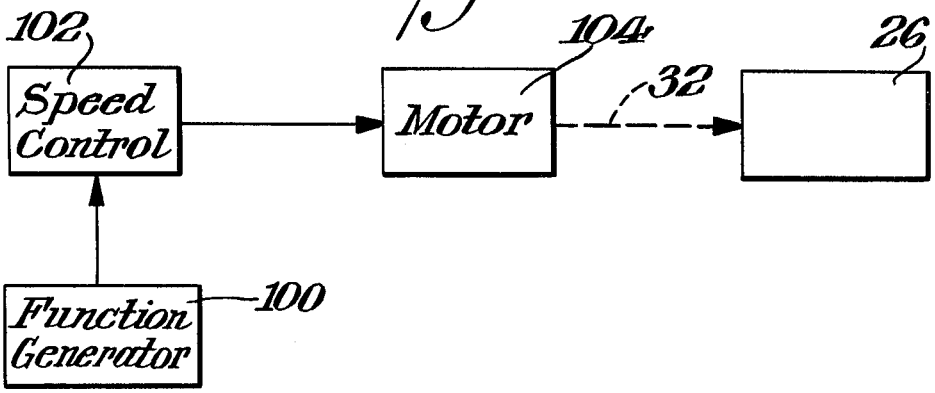
FIG. 4 is a block diagram of a rotor speed control that may find use with this invention.

Details of a particular analog or digital type speed control system are depicted in FIG. 4. Thus, the function generator 100, which may be any of the available integrated circuit chips available for producing an exponential function, is coupled to a conventional speed control circuit depicted by the block 102. This circuit described may be that used in the RC5B centrifuge sold by E. I. du Pont de Nemours and Company. The speed control circuit used in this centrifuge is that of a saturable core reactor. The speed control circuit varies the power available to the motor 104 such that the centrifuge rotor spin speed is immediately decreased when the power is diminished. In most applications using conventional centrifuges no deliberate reversal of motor torque or deliberate braking is required to achieve the exponential decay characteristic, since the friction and windage effects are sufficient to produce slowing at a higher rate than that required by any normal time constant $\tau$ anticipated for analyses. However, the accuracy of rotor speed and subsequent analysis results are improved by interfacing the control of rotor speed with a microprocessor or computer that continuously measures the speed and adjusts the power input to maintain the desired speed program.

In alternative embodiments of the invention, the flow velocity of the mobile phase or carrier fluid is increased in an exponential manner. Such variation enhances analysis convenience and accuracy. Preferably, the initiation of the flow velocity increase is delayed in a manner similar to the force field programming described above. This flow velocity increase is applicable to all types of field flow fractionation techniques the same as force field programming. The advantages of these approaches are especially apparent when a large range of particle sizes in a sample are to be fractionated, in particular, when very small particles are present, and when analysis time needs to be shortened.

Instrumental band broadening in SFFF for particulates increases significantly with increase in mobile phase average velocity. In a separation with constant rotor speed, $\omega$, and constant flow rate F, (or constant average velocity, $\langle v \rangle$), a very small, lightly retained particles elute with poor resolution and often are badly overlapped or unresolved from the channel void peak, $V_o$; larger particles are eluted at increasing nonlinear retention times as broad peaks and are often difficult to detect.

Using the method of the present invention, compared to constant force field, constant flow operation, enhanced separation of very small, lightly retained particles from the potentially interfering channel void volume band, $V_o$, is obtained by initiating the separation at a very low constant mobile phase velocity or flowrate. This permits particulate bands to elute with maximum sharpness (minimum band width or volume). Mobile phase velocity is then increased exponentially to rapidly elute larger particles that are increasingly more strongly retained. Thus, with an exponential velocity increase profile, an initial low velocity or flow rate produces maximum resolution of the lightly retained, small particles at the beginning of a separation. An exponential increase then causes larger, more highly retained peaks to rapidly elute so that, relative to constant velocity or flow, separation time is greatly decreased, later-eluting peaks are greatly sharpened, and approximately equal resolution is maintained for all particle bands throughout the separation.

Additional improvements in the convenience and accuracy of particle size analysis is obtained by using a preferred aspect of this invention, mainly, a time-delayed exponential mobile phase velocity increase. If the time delay is selected to be equal to the time constant of the exponential increase, an increased range of linearity between the log of the retention time of the particulates and the characteristic of the particulates on which the force field acts.

In short, velocity or flow programming in field flow fractionation is a useful technique for increasing the front-end resolution of sample components where separation is often less than adequate, while sacrificing resolution at the back-end of the fractogram where resolution is often greater than required.

Further, in the case of SFFF, exponential-increase mobile phase velocity programming provides convenient logarithm-linear particulate-size or molecular weight versus retention time relationships for quantitative particulate size or molecular weight analysis, in much the same manner as the exponential-decay force field programming method herein described.

A methematical analysis relating the retention time, molecular weight, and particle size may be made for SFFF application. Thus, simple exponential-mobile phase velocity programmed SFFF, the average linear velocity $\langle v \rangle$ becomes a function of time, that is:

$$L = \int_{O}^{t_R} R < v >_t dt \quad (23)$$

in this case, R is expressed by Equations 1–3, except that velocity $<v>_5$ is now a time-dependent exponential function:

$$<v>_t = <v>_o e^{t/\tau} \quad (24)$$

Equations 2, 5, 23 and 24 lead to the following calibration relationship for exponential flow-programmed SFFF:

$$\ln M = \ln[A'(1-e^{-t_R/\tau})] + t_R/\tau \quad (25)$$

where, $$A' = \frac{6\tau R_o T < v >_o}{LGW(\Delta\rho/\rho_s)} \quad (26)$$

For SFFF peaks resulting from relative large $t_R$ to $\tau$ ratios, Equation 27 closely approaches the log-linear approximation:

$$\ln M = \ln A' + t_R/\tau \quad (27)$$

From this expression, it is apparent that there is a linear relationship between the logarithm of particulate mass with the retention time $t_R$. In the case of spherical particles, ln $d_p$ is proportional to ln M and hence is proportional to $t_R$.

The log linear relationship mathematically described above can be modified in a preferred approach to increase the range of retention times that are linearly related to the logarithm of the particulate characteristic being influenced by the force field. In the case of SFFF, the characteristic is effective mass. This preferred time-delay exponential mobile phase velocity programming approach provides a wider linear range of logarithmic separations with improved accuracy and convenience. Separations in this case are carried out by initially using a low, constant flow rate which is held for a time equal to the time constant $\tau$ of the exponential flow rate programming, so that lightly retained particulate bands elute with maximum sharpness. After this time delay, the flow rate is increased exponentially to rapidly elute larger particles that are increasingly more strongly retained.

This may be more clearly understood by the following mathematical development. A general form of the time delayed exponential mobile phase velocity programming relationship is:

$$<v>_t = <v>_o e^{(t-\chi)/\tau} (t > \chi) \quad (28)$$

where $\chi$=an arbitrary delay time (min). When $\chi=0$, Equation 28 reduces to Equation 24 for simple exponential programming. In this case, SFFF retention characteristics under flow rate programming are as follows: for $t \leqq \chi$, $$L = 6\phi'/M <v>_o \chi \quad (29)$$

for $t \leqq \chi$, $$L = 6\phi'/M <v>_o [\chi + \tau e(t_R - \chi)/\tau - \tau] \quad (30)$$

where, $$\phi' = \frac{R_o T}{GW(\Delta\rho/\rho_s)} \quad (31)$$

Note that a true log-linear relationship is obtained for $t_R > \chi$ by allowing $\chi$ to equal $\tau$ in Equation 30. With this unique situation, logarithmic separations in SFFF can be optimized.

In a preferred SFFF operation, following sample injection, the flow is started and the initial mobile phase velocity $<v>_o$ is maintained constant for a time equal to time $\tau$ which is also the exponential time constant. After time $\tau$ the mobile phase velocity is allowed to exponentially increase with the time constant $\tau$.

for $t=\tau$, $$<v> = <v>_o \quad (32)$$

$$M = 6\phi'(t_R/t_o) \quad (33)$$

for $t > \tau$, $$<v> = <v>_o e^{(t-\tau)/\tau} \quad (34)$$

$$M = 6\phi' \left(\frac{\tau}{et_o}\right) e^{t_R/\tau} \quad (35)$$

For the desired logarithm function, Equation 35 becomes:

$$\ln M = \ln \alpha' + t_R/\tau \quad (36)$$

$$\ln d_p = \ln \beta' + t_R/3\tau \quad (37)$$

where, $$\alpha' = \frac{6R_o T\tau < v >_o}{eLGW(\Delta\rho/\rho_s)} \quad (38)$$

and, $$\beta' = \left(\frac{36kT\tau < v >_o}{\pi eLGW\Delta\rho}\right)^{\frac{1}{3}} \quad (39)$$

Equations 33 and 35–39 were derived for high retained components where $R \sim 6\lambda$. It may be shown (such showing is omitted here for the sake of brevity) that the effect of using the higher order approximation of R is only noticeable at peak retention values approaching $t_o$, which is of little practical consequence. This result indicates that the use of the rigorous but complex expression for R in Equation 1 is not expected to further influence the calibration curve characteristic significantly. On the contrary, equations 36 and 37 should be sufficiently accurate for most particle retention regions of practical interest.

Compared to simple exponential mobile phase velocity programming, this time-delay exponential method results in a wider linear range of lorgarithmic SFF separations. It also should be noted that by using the method of this invention that the slope of the log-linear relationship depicted by Equation 36 is controlled only by $\tau$ values. Initial flow rate, field strength, and other instrumental factors such as channel thickness affect only the intercept of the retention calibration plot.

In contrast to exponential field-decay programming, in exponential flow rate programming, for the same separation time, the average distance of the particle layer from the wall l is less during the separation. This factor generally results in higher resolution for exponential flow rate programmed separations per unit time, because shorter diffusion distances are required, resulting in sharper bands and better separation. Contrarily, separations with exponential flow rate programming will be more susceptible to problems associated with surface roughness and adsorption effects of the channel wall. Also, the effect of sample overloading will be more noticeable. Of course, larger volumes of mobile phase solvent are used in exponential flow rate programming relative to exponential force field programming.

In another alternative embodiment of the method of this invention, time-delayed exponential programming of mobile phase solvent density may be used, but only for SFFF. This density programming provides unique advantages in the SFFF separation of particulates, not only as to convenience, but also as to the accuracy of particle size analyses. The simple exponential increase or decrease in mobile phase density during SFFF separation has previously been described by S. J. F. Yang, et al., in Anal. Chem., 46, 1924 (1974); however, the advantages of time-delayed exponential mobile phase density programming were not recognized.

The exponential increase (when $\Delta\rho<0$) or decrease (when $\Delta\rho>0$) in the difference between particulate mobile phase density in SFFF separations with a specific time delay-$\tau$ value provides convenient logarithmic-linear particulate size or molecular weight versus retention time plots for quantitative particulate size or molecular weight analyses in much the same manner as for the exponential-decay force field programming approach herein described. Furthermore, time-delay exponential density programming also results in a significant improvement which takes the form of a wider linear range of logarithmic SFFF separations, relative to simple exponential density programming, just as in the cases for time-delayed force field and flow programming.

This log-linear relationship can be modified to increase the range of retention times that are linearly related to the logarithm of the particulate characteristic, in this case mass. This is accomplished in accordance with this invention by delaying the time of beginning the decrease in the density difference by making the time of delay equal to the time constant of the exponential decay.

In a preferred SFFF operation, following sample injection, the flow is started and the initial density difference $(\Delta\rho)_o$ is maintained constant for a time equal to time $\tau$ which is also the exponential time constant. After time $\tau$ the density difference is allowed to exponentially increase (when $\Delta\rho<0$) or decrease (when $\Delta\rho>0$) with the time constant $\tau$.

This time-delay exponential density programming method results in a relatively wider linear range of logarithmic SFFF separations. It also should be noted that by using the method of this invention that the slope of the log linear relationship is controlled only by $\tau$ values. Flow rate, field strength, and other instrumental factors such as channel thickness affect only the intercept of the retention calibration plot.

As with exponential-decay force field programming, a function generator of conventional type or a microprocessor or computer may be programmed to vary speed of the pump 33 (FIG. 2) thereby to vary the flow rate in accordance with the desired function. This function, as described above, may be the simple exponential or the preferred time-delayed exponential. This varying flow rate apparatus may be used to effect the method of this invention for all for forms of field flow fractionation including thermal, electrical, flow, sedimentation and others.

In the case of density programming, a conventional gradient pumping system, such as that employed in the Model 850 liquid chromatograph (E. I. du Pont de Nemours and Company, Wilmington, Del.) may be substituted for the reservoir 31 and pump 33 of FIG. 2. Using such a gradient pumping system, two reservoirs (not shown) of different density fluids may be selectively mixed to provide the varying density gradient desired for exponential density programming.

Thus, there is herein described a relatively unique and unexpected method and apparatus useful in field flow fractionation separations for not only reducing the separation times but also facilitating the analysis and enhancing the usefulness of the results obtained.

We claim:

1. A method for separating particulates, including macromolecules and particles, by introducing a sample of said particulates into a fluid medium, passing the fluid medium with sample suspended therein through a narrow flow channel, establishing a force field that influences a characteristic of said particulates across said flow channel to partition said particulates within said flow channel by selectively retarding different particulates according to their interaction with said influencing field and said fluid medium, comprising the step of:

varying one of the parameters that affects the interaction of said particulates with said field and said fluid medium to reduce the separation time and better equalize particle size separation, said parameters including decreasing the field strength exponentially as a function of time and increasing the flow velocity of said fluid medium exponentially as a function of time.

2. A method of claim 1 wherein said influencing field strength G is decreased according to the relationship $G(t)=G_oe^{-t/\tau}$ where G(t) is the influencing field strength at time t following the start of field decrease, $G_o$ is the strength of the influencing field at the start of field decrease, and $\tau$ is the time constant of the exponential decrease in field strength, whereby the retention time of said particulates in said flow channel is generally linearly related to the logarithm of said particulate characteristic.

3. A method of claim 1 or 2 wherein the influencing field is one selected from the group consisting of centrifugal, thermal, electrical, hydraulic or cross-flow, or magnetic force.

4. A method of claim 2 which includes the additional step of delaying the time of beginning the decrease in field strength by the value of $\tau$, the time constant of the exponential force-field decay.

5. A method of claim 1 wherein said influencing field through G is initially maintained constant at an initial strength $G_o$ for a time equal to $\tau$, and then is varied according to the relationship $G(t)=G_oe^{-t/\tau}$ where G(t) is the influencing field strength at time t following the start of field variation, $G_o$ is the strength of the influencing field at the start of field variation, and $\tau$ is the time constant of the exponential decrease in field strength, whereby the range of particulate retention times that are linearly related to the logarithm of said particulate characteristic is increased.

6. A method of claim 4 or 5 wherein the influencing field is one selected from the group consisting of centrifugal, thermal, electrical, hydraulic or cross-flow, or magnetic force.

7. A method of claim 1 wherein the average linear flow velocity $<v>$ of said fluid medium through said flow channel is increased according to the relationship $<v>_t=<v>_o e^{t/\tau}$ where $<v>_t$ is the average linear velocity of said fluid medium at time t following the start of flow, $<v>_o$ is the initial average linear velocity of carrier mobile phase, and $\tau$ is the time constant of the exponential increase in flow velocity, whereby the retention time of said particulates in said flow channel is generally linearly related to the logarithm of said particulate characteristics.

8. A method of claim 7 which includes the additional step of delaying the time of beginning the increase in flow velocity by the time $\tau$, the time constant of the exponential flow velocity increase.

9. In an apparatus for separating particulates, including macromolecules and particles, suspended in a fluid medium, said apparatus having a narrow flow channel, means for establishing a force field across said channel that influences a characteristic of said particulates, means for passing said fluid medium through said flow channel, means for introducing a sample of said particulate into said fluid medium for passage through said flow channel, the improvement wherein said field-establishing means includes programming means for decreasing the field strength exponentially as a function of time to reduce the separation time and better equalize particle size separation.

10. An apparatus of claim 9 wherein said programming means includes function-generating means for decreasing said influencing field strength G according to the relationship $G(t)=G_o e^{-t/\tau}$ where G(t) is the influencing field strength at time t following the start of field decrease, $G_0$ is the strength of the influencing field at the start of field decrease, and $\tau$ the time constant of the exponential decrease in field strength, whereby the retention time of said particulates in said flow channel is generally linearly related to the logarithm of said particulate characteristics.

11. An apparatus of claim 9 or 10 wherein said influencing field is a centrifugal force field, said means for establishing a field includes a prime mover for subjecting said flow channel to an angular momentum to establish a centrifugal force across said flow channel, and said programming means to decrease the angular speed of said flow channel.

12. An apparatus of claim 9 or 10 wherein said influencing field is a temperature gradient across said flow channel, said means for establishing said field includes a heating means adjacent to said flow channel for heating one wall of said flow channel relative to the other wall, and said programming means includes means for decreasing the energy supplied to said heating means.

13. An apparatus of claim 9 wherein said programming means including function-generating means for initially maintaining said influencing field G contant at an initial strength $G_o$ for a period of time equal to $\tau$, and then decreasing said field according to the relationship $G(t)=G_o e^{-t/\tau}$ where G(t) is the influencing field strength at time t following the start of field variation, $G_o$ is the strength of the influencing field at the start of field variation, and $\tau$ is the time constant of the variation in field strength, whereby the range of retention times that are linearly related to the logarithm of said particle characteristic is increased.

14. An apparatus of claim 9 or 13 wherein said influencing field is one selected from the group consisting of thermal, electrical, hydraulic or cross-flow, magnetic force.

15. In an apparatus for separating particulates, including macromolecules and particles, suspended in a fluid medium, said apparatus having a narrow flow channel, means for establishing a force field across said channel that influences a characteristic of said particulates, means for passing said fluid medium through said flow channel, means for introducing a sample of said particulates into said fluid medium for passage through said flow channel, the improvement wherein said means for passing said fluid medium through said flow channel includes programming means for increasing the flow velocity of said fluid medium exponentially as a function of time to reduce the separation time and better equalize particle size separation.

16. An apparatus of claim 15 wherein said programming means includes function generating means for increasing the flow velocity $<v>$ of said fluid medium through said flow channel according to the relationship $<v>_t=<v>_o e^{t/\tau}$ where $<v>_t$ is the average linear velocity of said fluid medium at time t following the start of flow, $<v>_o$ is the initial average linear velocity of carrier mobile phase, and $\tau$ is the time constant of the exponential increase in flow velocity, whereby the retention time of said particulates in said flow channel is generally linearly related to the logarithm of said particulate characteristics.

17. An apparatus of claim 15 or 16 wherein said function-generating means includes means for delaying the time of beginning the increase in flow velocity by the time $\tau$, the time constant of the exponential flow velocity increase.

* * * * *